US005398825A

United States Patent [19]

Erwin

[11] Patent Number: 5,398,825

[45] Date of Patent: Mar. 21, 1995

[54] WARNING SLEEVE FOR A PENDANT CONTROL

[75] Inventor: Michael S. Erwin, New Berlin, Wis.

[73] Assignee: Harnischfeger Corporation, Brookfield, Wis.

[21] Appl. No.: 98,515

[22] Filed: Jul. 28, 1993

[51] Int. Cl.[6] ..... B66C 13/44

[52] U.S. Cl. ..... 212/160; 40/316; 200/309; 212/271

[58] Field of Search ..... 212/160, 271, 157; 40/299, 309, 316; 200/309

[56] References Cited

U.S. PATENT DOCUMENTS

| | | | |
|---|---|---|---|
| 1,239,838 | 9/1917 | Spuchler . | |
| 1,298,981 | 4/1919 | Loughridge . | |
| 2,523,170 | 9/1950 | Wickerham . | |
| 2,929,161 | 3/1960 | Kuyk . | |
| 3,088,237 | 5/1963 | Plummer . | |
| 3,813,801 | 6/1974 | Vander Schaaf . | |
| 4,019,272 | 4/1977 | Kerz . | |
| 4,078,667 | 3/1978 | Navarro . | |
| 4,198,773 | 4/1980 | Batts et al. . | |
| 4,465,717 | 8/1984 | Crofts et al. . | |
| 4,584,238 | 4/1986 | Gen et al. | 40/316 |
| 4,927,383 | 5/1990 | Durkop et al. | 40/299 |
| 5,047,773 | 9/1991 | Seitsonen et al. . | |
| 5,115,586 | 5/1992 | Hawker . | |
| 5,138,784 | 8/1992 | Niwa . | |
| 5,207,746 | 5/1993 | Jones | 40/299 |
| 5,309,655 | 5/1994 | Mitchell | 40/299 |

*Primary Examiner*—David A. Bucci
*Assistant Examiner*—Thomas J. Brahan
*Attorney, Agent, or Firm*—Michael, Best & Friedrich

[57] ABSTRACT

A tubular warning sleeve for surrounding a pendant cord above a control station of an apparatus having a pendant control, the warning sleeve comprising a sheet of flexible material having opposite ends, the sheet including an outer surface having thereon warning information, the sheet being rolled up so that the ends overlap, and the ends being secured together by fasteners to form the sleeve, each of the ends of the sheet being provided with apertures for the fasteners, one of the ends of the sheet being provided with at least two sets of apertures for the fasteners such that the diameter of the sleeve is adjustable.

12 Claims, 1 Drawing Sheet

WARNING SLEEVE FOR A PENDANT CONTROL

BACKGROUND OF THE INVENTION

The invention relates to pendant controls for apparatus such as overhead travelling hoists. More particularly, the invention relates to devices for providing operating information and warnings to users of pendant controls.

ANSI safety standards require operating information and warnings to be provided to the user,of a pendant control. Such information must be located at or near the control station, so that the information can be readily seen by the user.

It is known to provide this information on a flat label or tag attached to the pendant cord above the control station. Such a tag is attached to the pendant cord by providing openings at the top and the bottom of the tag and threading the cord through the openings. The width of the tag is typically considerably greater than the diameter of the cord, so that the tag extends outwardly on either side of the cord.

SUMMARY OF THE INVENTION

The invention provides an improved device for providing the required operating information and warnings adjacent the control station of a pendant control. The device is a tubular sleeve which surrounds the pendant cord above the control station and which provides the required information. The invention also provides an overhead travelling hoist including a warning sleeve surrounding the pendant cord.

The tubular warning sleeve preferably comprises a sheet of flexible material having opposite ends, the sheet being wrapped around the pendant cord so that the ends overlap. The ends of the sheet are secured together by fasteners, such as rivets, which extent through apertures in the ends of the sheet. One end of the sheet includes at least two sets of apertures, so that the diameter of the sleeve can be adjusted by using a different set of apertures. The sleeve can thus be used on pendant cords having different diameters. The sleeve is preferably made of laminated plastic, although other suitable materials can be employed.

Securing the overlapping ends of the sheet together prevents accidental removal of the sleeve from the pendant cord. In an alternative embodiment of the invention, the sleeve is formed by a curved sheet having opposite ends, but the opposite ends are not secured together. Instead, the sleeve is split longitudinally. This facilitates removal of the sleeve from the cord, but this type of sleeve is more easily accidentally removed from the cord than is the sleeve with the opposite ends of the sheet secured together.

A principal feature of the invention is the provision of a warning device that is not likely to be accidently removed from the pendant cord and is not likely to be damaged or deformed during normal use of the pendant control. Also, the warning sleeve provided by the invention is not a nuisance to the operator, so it is not likely to be removed by the operator. Because the sleeve can be attached to the pendant cord after the pendant control is finally assembled, such as at the end of the manufacturing process or as a replacement, the sleeve will not be damaged during the manufacturing process.

Other features and advantages of the invention will become apparent to those skilled in the art upon review of the following detailed description, claims and drawings.

Figure 1:
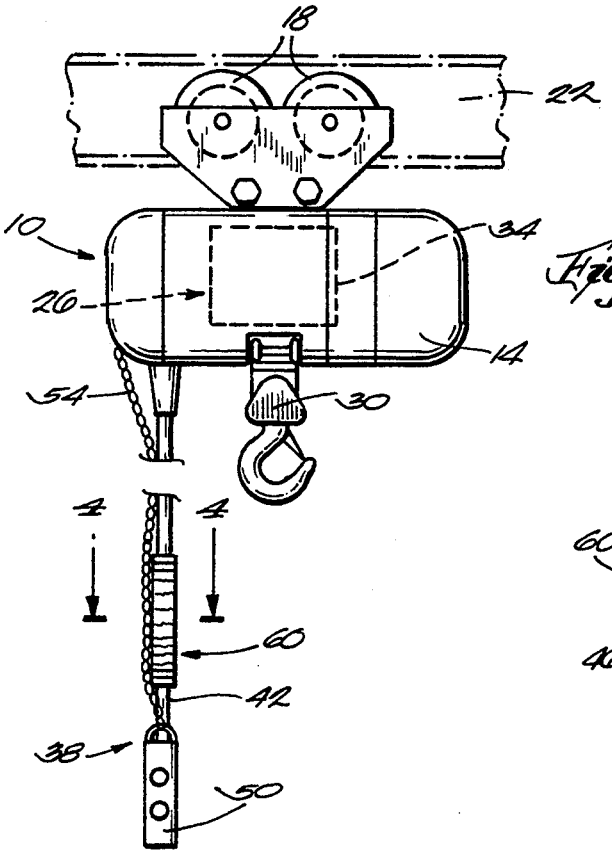
FIG. 1 is a side elevational view of an overhead travelling hoist which embodies the invention and which includes a warning sleeve surrounding a pendant cord.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF PREFERRED EMBODIMENT

An overhead travelling hoist 10 embodying the invention is illustrated in FIG. 1. Although the illustrated hoist 10 is powered electrically, it should be understood that the hoist 10 could be powered pneumatically or in other ways.

The hoist 10 comprises a housing 14 supported by wheels 18 for movement along an overhead track or rail 22. The housing 14 encloses and supports a hoist mechanism 26 for raising and lowering a bottom block 30 and thereby raising and lowering a load. The hoist mechanism 26 includes a motor 34 which, in the preferred embodiment of the invention, is electric.

The hoist 10 also comprises a pendant control 38 for the motor 34. The pendant control 38 includes a pendant cord 42 depending from the housing 14. The cord 42 encloses (see FIG. 4) electric wires or cables 46. (If the hoist 10 were pneumatic the cord 42 would house air hoses.) The pendant control 38 also includes a control station 50 connected to the lower end of the pendant cord 42. The electric wires in the cord 42 connect the control station 50 to the motor 34 so that the motor can be operated to raise or lower the load by pushing buttons on the control station 50. The control station 50 is supported by a strain chain 54 extending between the housing 14 and the control station 50. The hoist 10 as thus far described is conventional and will not be disclosed in greater detail.

The hoist 10 also comprises a tubular warning sleeve 60 surrounding the pendant cord 42 above the control station 50. The sleeve 60 is split longitudinally to facilitate wrapping the sleeve 60 around the cord 42 and to facilitate removal of the sleeve 60 from the cord 42. The sleeve 60 can rest either on top of the control station 50 or on top of a tie wrap (not shown) securing the strain chain 54 to the pendant cord 42.

The sleeve 60 is formed from (see FIG. 2) a sheet 64 of flexible material, preferably laminated plastic. The plastic is preferably a thermoset plastic, such as nylon, and should be able to tolerate temperatures over 200 degrees Fahrenheit. The plastic should be one that will not become brittle due to prolonged exposure to heat and is impervious to the oils and chemicals that are found in an industrial environment.

The sheet 64 has opposite ends (left and right ends in FIG. 2) and has a surface 68 which becomes the outer surface of the sleeve 60 when the sheet 64 is wrapped around the pendant cord 42. The sleeve surface 68 has thereon warning information and colors 72 required by ANSI safety standards. A lamination over the warning information and colors resists removal thereof This outer lamination also makes the sleeve surface 68 easy to clean. The sheet 64 is formed without any sharp edges that could damage the cord 42.

Figure 4:
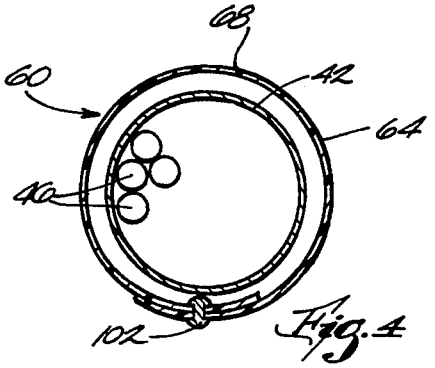
FIG. 4 is a sectional view taken along line 4—4 in FIG. 1.
Figure 3:
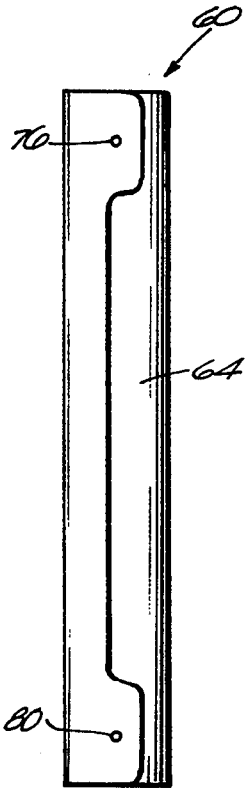
FIG. 3 is a view of the sleeve in its rolled-up condition.
Figure 2:
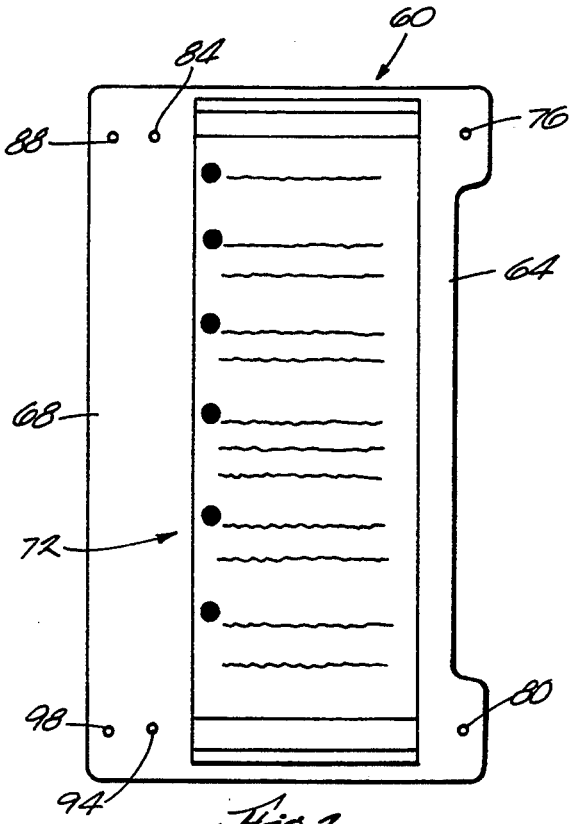
FIG. 2 is a view of the sleeve in its flat condition.

As shown in FIG. 2, the sheet 64 has therein, adjacent the right end of the sheet 64, upper and lower apertures 76 and 80, respectively. The sheet 64 also has therein, adjacent the left end of the sheet 64, upper apertures 84 and 88 and lower apertures 94 and 98. The apertures 84 and 94 define an inner set of apertures, and the apertures 88 and 98 define an outer set of apertures. As shown in FIG. 4, the sheet 64 is loosely wrapped around the cord 42 or rolled up around the cord 42 so that the ends of the sheet 64 overlap. This overlapping of the sheet ends is also shown in FIG. 3. The thickness of the sheet 64 should be such that the sheet 64 can be relatively easily rolled up but such that the sheet will not easily collapse.

The sheet ends can be overlapped so that either the inner apertures 84 and 94 or the outer apertures 88 and 98 are aligned with the apertures 76 and 80. The diameter of the sleeve 60 is greater when the outer apertures 88 and 98 are aligned with the apertures 76 and 80. The sleeve 60 should have a diameter that allows the sleeve to float freely on the cord 42 so that the warning information is effectively displayed and so that the sleeve does not hinder operation of the hoist 10.

The sheet ends are secured together by (see FIG. 4) fasteners 102 extending through the aligned apertures. The fasteners 201 are preferably plastic rivets, although any suitable fasteners can be employed. The fasteners 102 should be strong enough to resist accidental removal, yet should be easily removable with tools so as to permit removal of the sleeve 60 from the cord 42 when necessary.

As explained above, the sleeve 60 is not likely to be accidently removed from the cord 42 and is not likely to be damaged or deformed during normal use of the pendant control 38. Also, the warning sleeve 60 is not likely to be removed by the operator because the sleeve 60 does not interfere with operation of the hoist 10. Because the sleeve 60 can be attached to the pendant cord 42 at the end of the manufacturing process, the sleeve 60 will not be damaged during the manufacturing process.

In an alternative embodiment of the invention (not shown), the sleeve 60 could simply be a split sleeve without having the overlapping ends of the sheet 64 secured together. This would require the sheet material to be permanently set in a curved configuration. Such a sleeve is not believed to be as desirable as the above-described preferred embodiment of the invention because the split sleeve without fasteners could be more easily accidentally removed from the cord 42.

It should also be understood that the sleeve 60 can be used on any apparatus having a pendant control.

Various features of the invention are set forth in the following claims.

I claim:

1. An overhead traveling hoist comprising a housing adapted to be supported for movement along an overhead track, a hoist mechanism supported by said housing for raising and lowering a load, said hoist mechanism including a motor, a pendant control for said motor, said pendant control including a pendant cord depending from said housing and having a lower end, and a control station connected to said lower end of said pendant cord, and a tubular warning sleeve surrounding said pendant cord above said control station, said warning sleeve including an outer surface having thereon warning information, and said warning sleeve being split longitudinally to facilitate wrapping said sleeve around said cord and to facilitate removal of said sleeve from said cord.

2. A hoist as set forth in claim 1 wherein said sleeve comprises a sheet of flexible material having opposite ends, said sheet being curved so that said ends are adjacent and define said split.

3. A hoist as set forth in claim 2 wherein said ends are secured together to prevent accidental removal of said sleeve from said cord.

4. A hoist as set forth in claim 3 wherein said ends of said sheet are secured by fasteners.

5. A hoist as set forth in claim 4 wherein each of said ends of said sheet is provided with apertures for said fasteners.

6. A hoist as set forth in claim 5 wherein one of said ends of said sheet is provided with at least two sets of apertures for said fasteners such that the diameter of said sleeve is adjustable.

7. A hoist as set forth in claim 1 wherein said hoist is electric and said pendant cord contains electrical wires.

8. A hoist as set forth in claim 1 wherein said sheet is made of laminated plastic.

9. An overhead traveling hoist comprising a housing adapted to be supported for movement along an overhead track, a hoist mechanism supported by said housing for raising and lowering a load, said hoist mechanism including a motor, a pendant control for said motor, said pendant control including a pendant cord depending from said housing and having a lower end, and a control station connected to said lower of said pendant cord, and a tubular warning sleeve surrounding said pendant cord above said control station, said warning sleeve including an outer surface having thereon warning information, and said warning sleeve comprising a sheet of flexible material having opposite ends, said sheet being rolled up around said cord so that said ends overlap, and said ends being secured together by fasteners to form said sleeve, each of said ends of said sheet being provided with apertures for said fasteners, one of said ends of said sheet being provided with at least two sets of apertures for said fasteners such that the diameter of said sleeve is adjustable.

10. A hoist as set forth in claim 9 wherein said hoist is electric and said pendant cord contains electrical wires.

11. A hoist as set forth in claim 9 wherein said sheet is made of laminated plastic.

12. An overhead traveling hoist comprising a housing adapted to be supported for movement along an overhead track, a hoist mechanism supported by said housing for raising and lowering a load, said hoist mechanism including an electric motor, a pendant control for said motor, said pendant control including a pendant cord which depends from said housing, which contains electrical wires, and which has a lower end, and a control station connected to said lower end of said pendant cord, and a tubular warning sleeve which is made of plastic and which surrounds said pendant cord above said control station, said warning sleeve including an outer surface having thereon warning information, and said warning sleeve comprising a sheet of flexible material having opposite ends, said sheet being rolled up around said cord so that said ends overlap, and said ends being secured together by fasteners to form said sleeve, each of said ends of said sheet being provided with apertures for said fasteners, one of said ends of said sheet being provided with at least two sets of apertures for said fasteners such that the diameter of said sleeve is adjustable.

* * * * *

UNITED STATES PATENT AND TRADEMARK OFFICE

CERTIFICATE OF CORRECTION

PATENT NO. : 5,398,825

DATED : March 21, 1995

INVENTOR(S) : Michael S. Erwin

It is certified that error appears in the above-identified patent and that said Letters Patent is hereby corrected as shown below:

Column 4, line 45 (line 10 of Claim 9), after "lower" insert --end--.

Signed and Sealed this

Sixth Day of June, 1995

Bruce Lehman

*Attest:*

BRUCE LEHMAN

*Attesting Officer*

*Commissioner of Patents and Trademarks*